US009394635B2

(12) United States Patent
Ballabio et al.

(10) Patent No.: US 9,394,635 B2
(45) Date of Patent: Jul. 19, 2016

(54) WEFT FEEDER FOR WEAVING LOOMS

(75) Inventors: Alessandro Ballabio, Sala Biellese Bi (IT); Marco Covelli, Occhieppo Inferiore Bi (IT)

(73) Assignee: ROJ S.R.L., Bielle (IT)

( * ) Notice: Subject to any disclaimer, the term of this patent is extended or adjusted under 35 U.S.C. 154(b) by 503 days.

(21) Appl. No.: 13/993,149

(22) PCT Filed: Dec. 13, 2011

(86) PCT No.: PCT/IB2011/003029
§ 371 (c)(1),
(2), (4) Date: Jul. 9, 2013

(87) PCT Pub. No.: WO2012/080815
PCT Pub. Date: Jun. 21, 2012

(65) Prior Publication Data

US 2013/0276933 A1 Oct. 24, 2013

(30) Foreign Application Priority Data

Dec. 13, 2010 (IT) ..... MI2010A2276

(51) Int. Cl.
*G06F 19/00* (2011.01)
*D03D 47/36* (2006.01)

(52) U.S. Cl.
CPC ..... *D03D 47/367* (2013.01); *D03D 47/362* (2013.01)

(58) Field of Classification Search
CPC ..... D03D 47/361–47/367; D03D 47/34
See application file for complete search history.

(56) References Cited

U.S. PATENT DOCUMENTS

| | | | | |
|---|---|---|---|---|
| 4,850,400 | A | 7/1989 | Gorris | |
| 4,865,085 | A * | 9/1989 | Ghiardo | D03D 47/367 139/452 |
| 4,936,356 | A * | 6/1990 | Ghiardo | B65H 57/003 139/452 |
| 5,133,388 | A * | 7/1992 | Tholander | D03D 47/362 139/452 |
| 5,211,347 | A * | 5/1993 | Riva | D03D 47/367 242/364.7 |
| 5,377,922 | A | 1/1995 | Fredriksson et al. | |
| 5,613,528 | A * | 3/1997 | Zenoni | D03D 47/367 139/452 |

(Continued)

FOREIGN PATENT DOCUMENTS

| | | | |
|---|---|---|---|
| EP | 0290380 | A1 | 11/1988 |
| JP | 2006328581 | A | 12/2006 |

OTHER PUBLICATIONS

International Search Report for PCT/IB2011/003029 Feb. 1, 2013.

*Primary Examiner* — Nathan Durham
(74) *Attorney, Agent, or Firm* — Pearne & Gordon LLP

(57) ABSTRACT

A weft feeder device for threads, in particular for weaving looms, of the type comprising a main body (1) within which there is housed an electric motor for the driving of a rotary shaft (2), the rotary shaft (2) driving into rotation, with its middle portion, a rotor (3), and a drum (T) rotatably mounted on the end portion of said rotary shaft (2) and kept fixed by magnetic means (6, 7), and wherein there are furthermore provided pairs of optical emitting/receiving sensors (E, R) are respectively arranged on the drum (T) and on an extension of the main body (I) of the weft feeder device which extends laterally to the lateral surface of the drum (T), said pairs of sensors (E, R) being apt to detect the presence/absence of a thread passing therebetween. The outer surface of said drum (T) consists of multiple independent sectors (4), and said emitting sensors (E) and the relative feeding and control circuit are embedded in the thickness of one (4*s*) of said sectors (4), arranged opposite said extension (10) of the main body (1) of the weft feeder device.

10 Claims, 6 Drawing Sheets

(56) References Cited

U.S. PATENT DOCUMENTS 5,765,399 A * 6/1998 Huss ..... D04B 15/486 139/452
5,983,955 A * 11/1999 Hellstroem ..... D03D 47/367 139/452
6,044,871 A * 4/2000 Zenoni ..... D03D 47/367 139/452
6,062,501 A * 5/2000 Halvarsson ..... H03K 17/97 139/452
6,409,114 B1 * 6/2002 Magnusson ..... D03D 47/367 242/364.7

* cited by examiner

WEFT FEEDER FOR WEAVING LOOMS

FIELD OF THE INVENTION

The present invention refers to a weft feeder of weaving threads, in particular for weaving looms.

BACKGROUND OF THE PRIOR ART

Weft feeding devices for weaving looms are apparatuses which are arranged between the loom and the thread reels which feed the weft to the loom, to perform the function of unwinding the thread off the reels and hence make it available to the weft insertion devices, keeping the thread tension within acceptable levels during the entire weft insertion operation, and hence avoiding the abrupt tension peaks in the thread which occur instead upon weft insertion in looms without weft feeders. This object is achieved through the presence, in the weft feeder, of a winding assembly which regularly and at a lower average speed takes the weft thread from the reels, accumulating it in successive coils on a stationary cylindrical drum whereon it hence forms a thread stock. Such stock is then collected, discontinuously and at high speed, by the weft insertion devices (launch nozzles or grippers) of the loom.

The weft feeder is an apparatus which has been in use in weaving looms for many years now, in particular since modern high-speed looms have been introduced, wherein the direct feeding from the reels has never been technically possible. During its evolution over the years, in addition to the basic functions recalled above, the weft feeder has acquired additional control functions which allow to verify the constant presence of thread in the critical points of the weft feeder, to adjust the amount of thread accumulated in the stock and the distance between the individual coils, to brake the outgoing thread to limit the dynamic effects determined by the abrupt acceleration during its collection by the weft insertion devices, to measure the length of the thread portion collected by the insertion devices, and hence to stop thread collection as soon as a predetermined length thereof has been supplied.

These different functions are obtained due to the presence, aboard the weft feeder, of a processing unit which operates on the basis of sophisticated algorithms, starting from electric signals for the detection of the thread presence/absence in correspondence of the above-said critical points of the apparatus. These electric signals are currently obtained by means of pairs of emitting/receiving optic sensors arranged on the weft feeder so that the path of the optic radiation between an emitting sensor and a receiving sensor intercepts the thread path in a desired control position. Depending on the type of path of the optic radiation, and consequently of the positioning of the LED optic sensors on the weft feeder, current weft feeders divide into two categories.

In a first weft feeder category, both emitting sensors and receiving sensors are arranged on a support arm which projects from the main body of the weft feeder and extends parallel to the lateral surface of the drum, and the path of the optic radiation between each pair of sensors is obtained through a respective reflecting surface fastened to the lateral surface of the drum which faces said support arm, in a carefully preset position and angle.

In a second, more recent weft feeder category, the emitting sensors are instead arranged precisely on the lateral surface of the stationary drum, while the receiving sensors remain in the above already described position on the support arm. In this second weft feeder category one has the advantage that the optic radiation emitted by the emitting sensors is directly intercepted by the receiving sensors, and hence the relative electric signal corresponding to the presence/absence of such optic radiation (which signal is determined by the absence or presence, respectively, of a thread through the path of the optic radiation) is much stronger and more stable with respect to the one of the preceding reflection system. On the other hand, this second weft feeder category has the disadvantage of not being able to supply the energy necessary for activating the emitting sensors through standard electric cables since, as it is well known to people skilled in the field, the stationary drum of the weft feeder is kept in a stable position on the rotary shaft of the weft feeder solely through magnetic means to allow that a rotor, integral with said rotary shaft and apt to perform the winding of thread coils on the drum, be housed between the weft feeder body and the drum. There is hence no fixed mechanical connection of the drum to the weft feeder body along which a conventional electric connection may pass and hence the electric supply of the emitting sensors must be obtained through independent means arranged inside the drum (batteries), or through induction supply assemblies comprising a pair of electric coils housed on the weft feeder body and on the drum, respectively.

In the most recent years, as the above-said different performances of weft feeders became increasingly more complete and reliable, a new feature of these apparatuses has become important, i.e. the flexibility of application thereof on the most diverse weaving machines. As a matter of fact, this application flexibility is highly in demand with weavers, who can thus free themselves from the need to arrange various types of weft feeders depending on the different weaving machines they have to be intended for or on the different types or colours of threads used for weft formation.

In fact, in general high operation flexibility of the weft feeder upon variation of the conditions of the supplied thread is required by weavers, both as far as the thread count and the thread colour is concerned. Specifically, it is required for the weft feeder to be able to operate regularly also in the presence of very thin threads or of darkly-coloured or clear or highly reflective threads, which threads are hence harder to be optically detected.

In particular, as far as measuring weft feeders are concerned—i.e. those weft feeders which are capable of measuring the amount of thread collected by the insertion devices and to halt the collection thereof upon reaching a preset length, today mainly used in air looms and water looms—it is highly appreciated by users the fact that such length may be varied within a wide range of measures, depending both on the type of weaving machine and on the height of the individual fabric being woven. To reach this aim, in addition to obviously varying the number of thread coils accumulated on the drum which are released for each insertion, it is already known to form the drum itself through multiple, independent cylinder sectors, the radial position of said sectors being manually adjustable between a minimum-radius position and a maximum-radius position. However, while this last (maximum-radius) condition may be determined at will during the design stage of the weft feeder, the minimum-radius condition is instead naturally limited by the bulk of the devices which must be housed inside the drum. In the category of direct optic-sensor weft feeders which is targeted by the present invention, among these devices there are hence also the emitting sensors and the corresponding induction supply circuit of said sensors, electric coils included, and this has caused, precisely because of the additional bulk determined by these devices, this category of weft feeders to have so far a smaller flexibility of use, in the field of short weft lengths, compared to weft feeders with reflexion optic sensors.

Problem and Solution

The general problem of the present invention is hence that of providing a new weft feeder structure with direct sensors which exhibits a high flexibility of use with respect to the different varying parameters of use, in particular as concerns the length of collected thread, thread count and thread colour.

A first object of the present invention is hence that of overcoming the above-described limits which concern the field of minimum weft lengths which may be collected by the weft feeder, offering a flexibility of use fully similar to the one of the weft feeders provided with reflection sensors and hence allowing to extend the relevant advantages of the direct sensor weft feeders also to the field of low-height fabrics.

A second object of the present invention is furthermore that of improving the sensitivity and selectivity of the receiving sensors, in particular towards low-count threads and/or very dark, clear or highly reflective threads.

A third object of the invention, still in the scope of the same general problem indicated above, is finally that of allowing a more regular collection of the thread from the drum, especially with reference to the high-count wefts. Said wefts, as known, during their collection cause the so-called ballooning effect (forming of a large thread loop in the air in front of the drum, caused by dynamic impact imparted to the thread, upon collection of the same by the insertion devices).

The above-said main object is achieved, according to the present invention, through a direct-sensor weft feeder having the features defined in claim 1. In the dependent claims there are furthermore defined preferential and additional features of the invention, which features allow to reach the further objects indicated above.

BRIEF DESCRIPTION OF THE DRAWINGS

Further features and advantages of the weft feeder according to the present invention will in any case be more evident from the following detailed description of a preferred embodiment of the same, provided merely as a non-limiting example and illustrated in the attached drawings, wherein.

DETAILED DESCRIPTION OF THE PREFERRED EMBODIMENT

Figure 1:
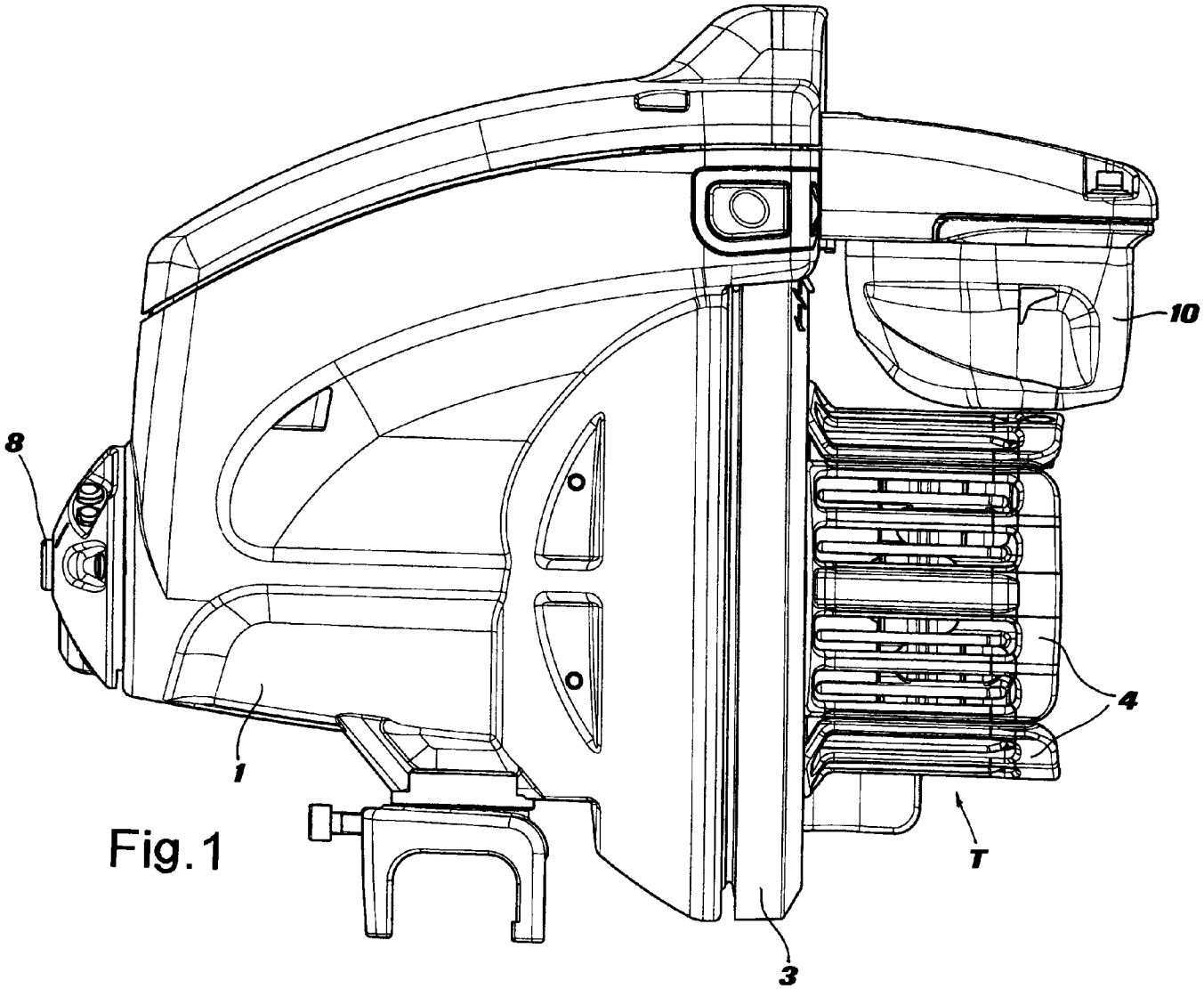
FIG. 1 shows an elevation lateral view of the weft feeder according to the present invention.
Figure 2:
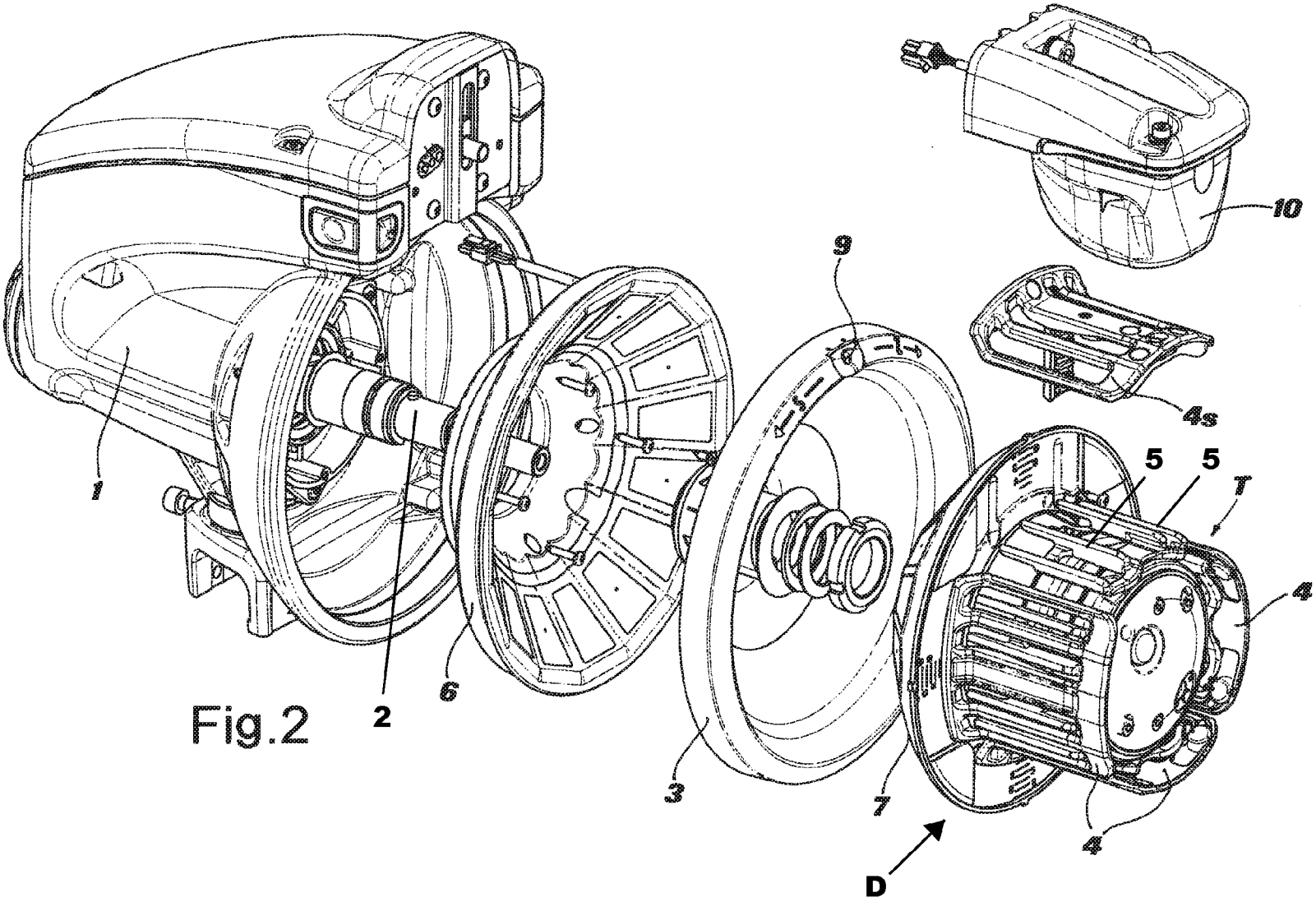
FIG. 2 shows an exploded view of the main components of the weft feeder of FIG. 1.

In FIGS. 1 and 2 the general structure, known per se, of the weft feeder according to the present invention is clearly shown. Such weft feeder consists of a main body 1 within which an electric motor for driving a rotary hollow shaft 2 is housed. Rotary shaft 2 drives into rotation, with the middle portion thereof, a cup rotor 3, and with the end portion thereof an eccentric device D rotatably housed within a drum T. Rotor 3 and eccentric device D may be formed integrally with shaft 2, or they may be constructed as separate elements which are then made integral with shaft 2 in any known manner, for example by keying on. The outer surface of drum T consists of multiple, mutually independent sectors 4, which are provided with wide cut-outs through which fingers 5 integral with said eccentric device D may pass. The position of sectors 4 is radially adjustable so as the diameter of drum T can be changed and consequently the length of each individual thread coil wound thereon and hence the overall thread amount accumulated on the drum can be varied.

Rotor 3 rotates within a gap formed between two permanent-magnet elements, also cup-shaped, and precisely a fixed magnet cup 6, integral with body 1 and a floating magnet cup 7 integral with the drum T, which last is positioned on the opposite side of the magnets. Magnets of the magnet cups 6 and 7 are arranged so as to determine a strong mutual attraction between the two cups, which attraction is sufficient to keep fixed with respect to rotation the position of drum T, despite the absence of any mechanical connection with main body 1 and despite the dragging action imparted onto drum T by rotary shaft 2 whereon drum T and magnet cup 7 are supported through bearings which determine the axial position thereof.

The thread coming from the reel (not shown) axially enters the hollow shaft 2 of the weft feeder, from the rear end 8 thereof, and comes out of an exit opening 9 formed at the periphery of rotor 3, through a channel internally formed in the same and in connection with the axial cavity of shaft 2. When rotor 3 is driven into rotation, the thread collected from the reel is arranged into successive coils on the sectors 4 of drum T. The simultaneous rotation of the eccentric device D, itself driven by shaft 2 into rotation within drum T, then determines a progressive displacement of the thread coils onto sectors 4, moving away from rotor 3 and at a constant and adjustable mutual distance, through the movement of fingers 5 which cyclically come out of sectors 4 and go back therein. Weft feeders devoid of the eccentric device D and of the respective fingers 5 thereof also exist, wherein the coils are hence wound onto drum T one in contact with the other; the present invention may anyhow be identically applied also to this type of weft feeder.

According to the present invention, from the upper area of the main body 1 of the weft feeder finally, instead of a conventional support arm, a control block 10 projects, within which, as better described in the following, both receiving sensors R are housed and the electromagnetic stopping device of the thread collection from drum T, consisting of a pin which comes out of block 10 and enters a corresponding hole F of sector 4*s* of drum T facing thereon, preventing the unwinding of the thread coils from the drum when the number of released coils has reached the number corresponding to the desired weft length.

As stated in the introductory part of this disclosure, a main object of the invention is to avoid that the introduction of the emitting sensors and of the relative electric supply system within drum T causes an increase of the minimum outer diameter of drum T with respect to the one strictly necessary for housing the sole eccentric device D which controls fingers 5, as occurs precisely in weft feeders with reflection sensors.

Figure 3:
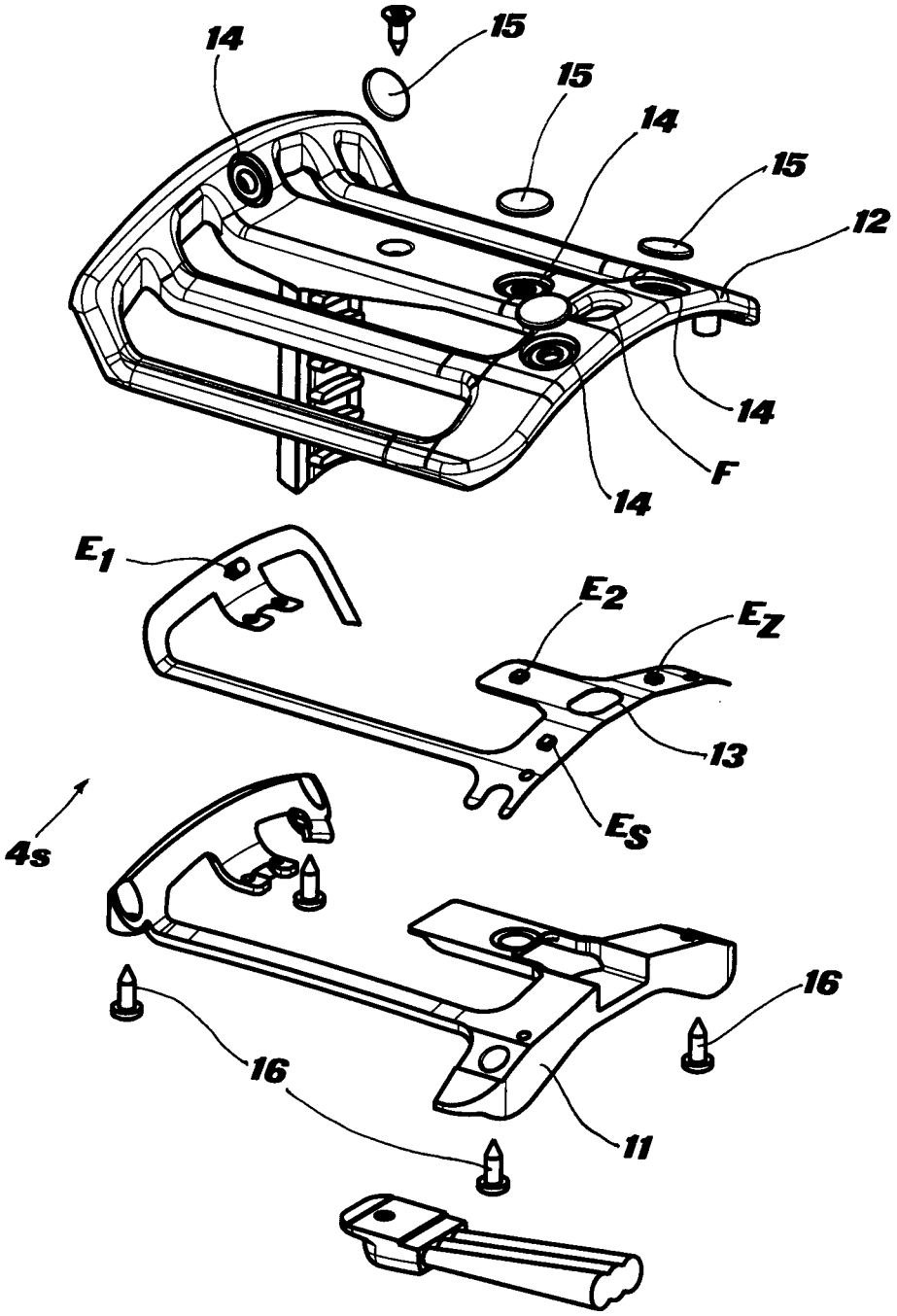
FIG. 3 is an exploded view of the upper sector of the drum of the weft feeder of FIG. 1, and of the supply circuit of the emitting sensors.

In order to obtain this result, in the weft feeder of the present invention emitting sensors E are embedded in the upper sector 4*s* of drum T having the particular structure which is illustrated in detail in FIG. 3. As a matter of fact, from the exploded view of this drawing it can be observed that sector 4*s*, unlike the other sectors of drum T which consist of a single piece, consists of the coupling between a base portion 11 and a covering portion 12, between which a flexible, extra-thin printed circuit 13 is sandwiched. The emitting sensors E are SMD-type LEDs, i.e. extremely small, surface-mounted devices, which are wired in advance to the flexible printed circuit 13. In the illustrated embodiment, the emitting sensors E are 4 and precisely a sensor $E_1$ meant to detect the thread coils incoming onto drum T and then to monitor any thread breakage, a sensor $E_2$ meant to detect the condition of complete filling of the thread stock on drum T and finally a pair of sensors $E_S$ and $E_Z$ which allow to count the coils going out from the drum, in case of thread stock accumulated in the rotation directions S or Z of rotor 3, respectively. Sensors $E_S$ and $E_Z$ are arranged at a same short distance, on both sides, of the hole F housing thread stopping pin 23 and hence in a perfectly symmetrical way both with respect to said hole F and to sensor $E_2$. This close and symmetrical arrangement of sensors E—made possible by the particular structure of sector 4*s* and by the one, which will be described later, of control block 10—allows to have a highly stable and accurate signal when the thread passes on the sensors, said signal being perfectly symmetrical for both directions of rotation of the rotor, and a better cleaning action of the sensors by the same thread.

While mounting sector 4*s*, the base portion 11 and the covering portion 12 are mutually coupled after having arranged in between flexible printed circuit 13 so that emitting sensors E position themselves into respective circular seats 14 provided in covering portion 12, which seats are then closed above by clear sapphire slides 15, provided with high resistance to wear, and below by an oil-resistant resin, blocking then the assembly with four screws 16. Due to this structure, sector 4*s* has, in a radial direction, a thickness substantially equal to that of the other sectors 4 and there is hence no increase—due to the presence of emitting sensors E inside drum T—of the minimum diameter of the same drum T and, consequently, of the minimum thread length which may be collected by the weft feeder.

Figure 4:
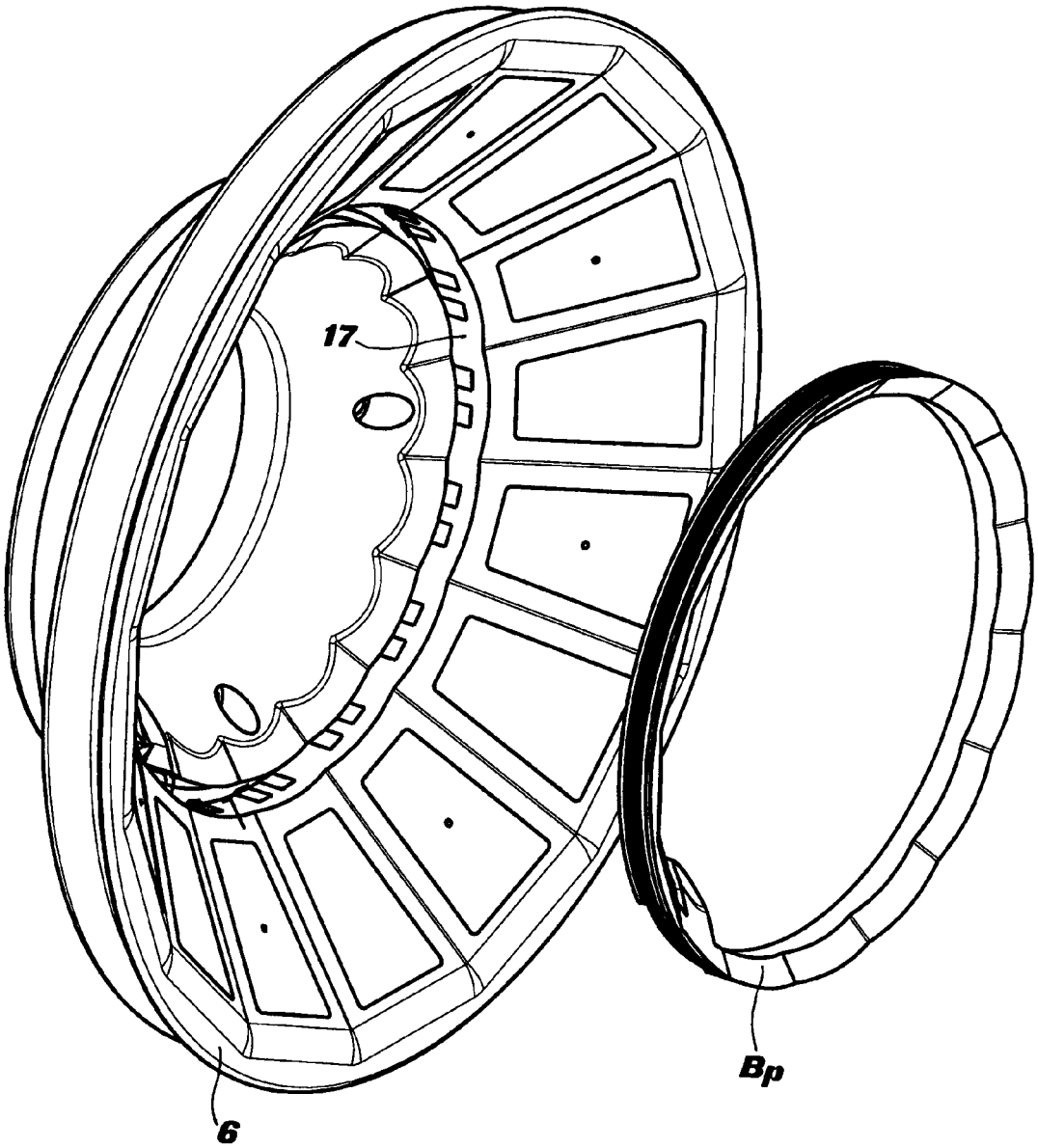
FIG. 4 is an exploded view of the fixed magnet cup of the weft feeder of FIG. 1.
Figure 5:
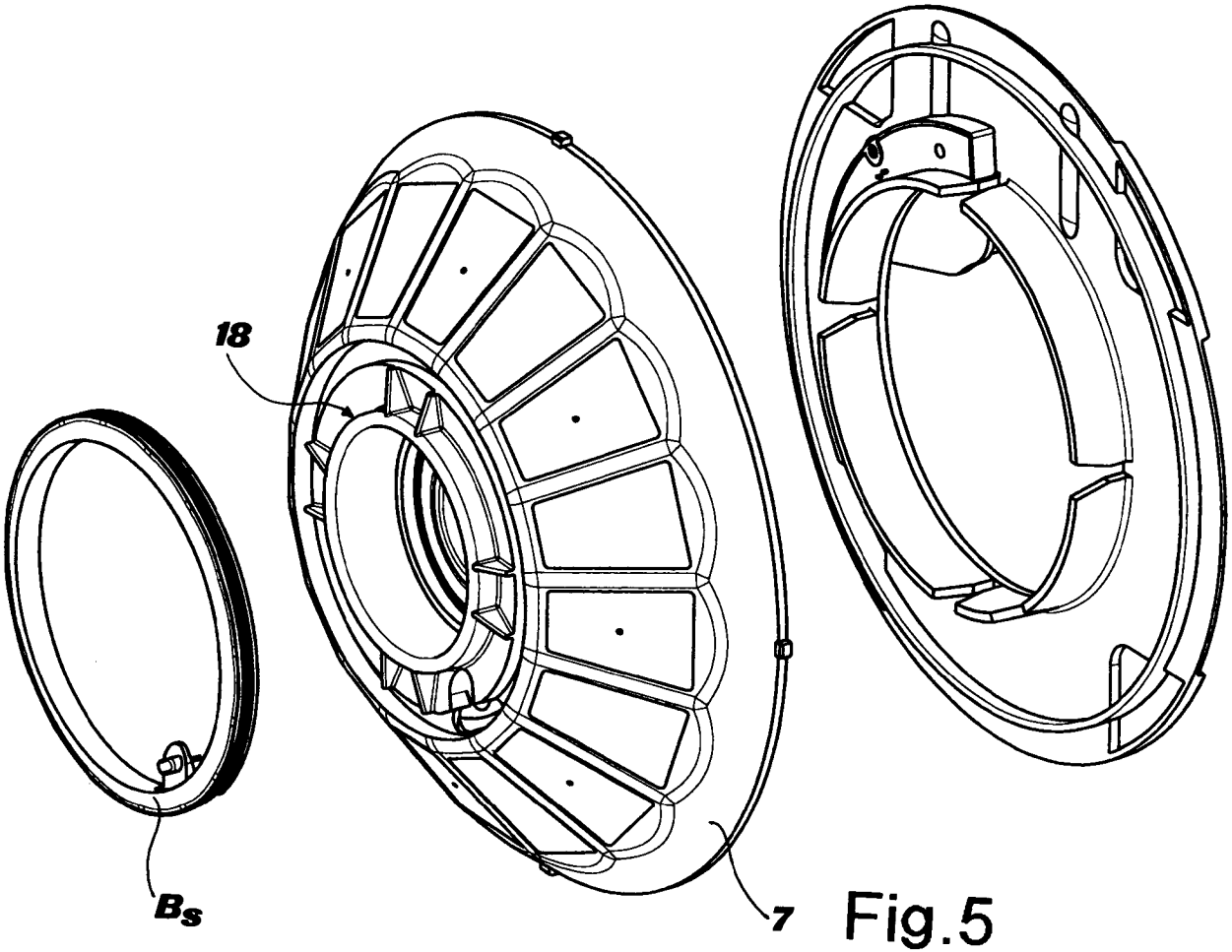
FIG. 5 is an exploded view of the floating magnet cup of the weft feeder of FIG. 1.
Figure 6:
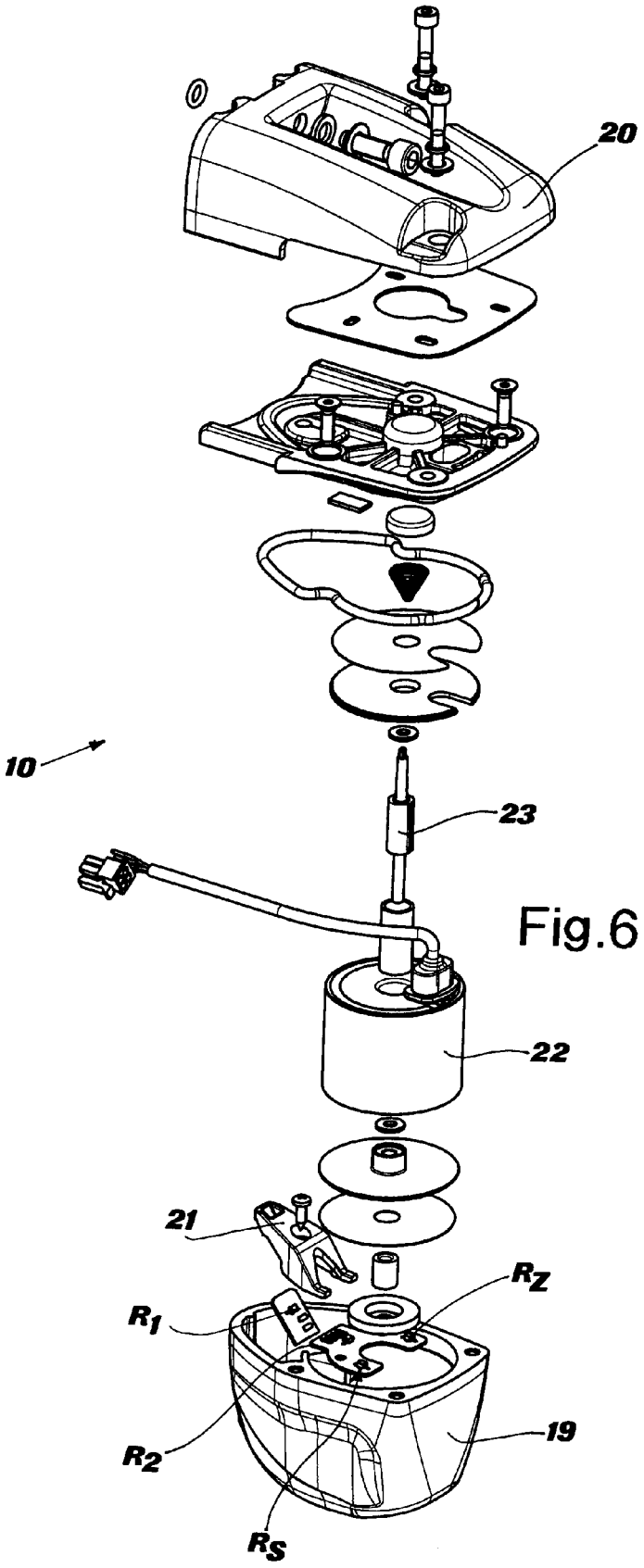
FIG. 6 is an exploded view of the block housing the electromagnetic thread-stopping device of the weft feeder of FIG. 1, incorporating the receiving sensors.

Again for the purpose of freeing drum T from any component which is not strictly necessary, in the weft feeder according to the present invention a particularly handy and effective location has been provided for the pair of electric coils B which make up the inductive, electric power supply device of emitting sensors E, which location can be immediately observed from the illustrations of FIGS. 4 and 5, which refer to fixed magnet cup 6, integral with weft feeder body 1, and to the floating magnet cup 7, integral with drum T, respectively.

Both electric coils B have an annular shape and are housed in corresponding annular seats provided in cups 6 and 7, concentrically to shaft 2. In particular primary electric coil $B_p$ is housed in an annular seat 17 formed in the concave face of magnet cup 6, while secondary electric coil $B_s$ is housed in an annular seat 18 formed in the convex face of magnet cup 7. Thanks to this construction, the two electric coils B, in addition to leaving the area of drum T completely free, are also perfectly integrated in magnet cups 6 and 7, and therefore they do not affect in any way the functionality of said cups. Said electric coils $B_p$ and $B_s$ preferably have same diameters or diameters only slightly different, so that they face each other at a short mutual distance for the entire extent thereof, mutually separated only by the thickness of rotor 3, built of non-conducive plastic material. This hence allows to obtain a high efficiency of current production in the circuit of secondary electric coil Bs, hence fully sufficient for supplying emitting sensors E.

A further improvement innovation of the weft feeder of the present invention finally concerns the arrangement of receiving sensors R, in order to be able to couple them correctly and effectively with the innovative arrangement of above-described emitting sensors E. As a matter of fact, according to the invention, said receiving sensors R are housed within a single control block 10, wherein the electromagnetic thread-stopping device is also housed. Control block 10 preferably consists of an aluminium casting comprising a lower portion 19 wherein the above-said components are housed and an upper portion 20 serving both as a lid and as a cantilever fastening element of block 10 to the body 1 of the weft feeder. As clearly shown in FIGS. 1 and 2, the outer surface of lower portion 19 is all evenly radiused, i.e. entirely free from sharp edges and corners and furthermore in the front area, i.e. on the side not-facing body 1, it is sharply tapered, so as to reduce the bulk of the same to the one strictly necessary for housing the electromagnetic thread-stopping device.

Receiving sensors R preferably consist of SMD-type phototransistors wired on two separate, rigid printed circuits (and precisely one for each plane in which emitting sensors R lie) which are introduced into suitable pre-formed seats in lower portion 19 of block 10 and are blocked in position by a single clamp 21 fastened to said portion 19 by screw means. In particular, a first, rectangular printed circuit with inclined attitude carries receiving sensor $R_1$, while a second, Y-shaped printed circuit with horizontal attitude carries receiving sensors $R_2$, $R_Z$ and $R_S$, each one of said sensors being functionally coupled with the corresponding emitting sensor E which carries the same index. Alternatively, it is possible to use in this case too a single, flexible printed circuit containing all receiving sensors R, suitably changing the shape and size of clamp 21 so as to guarantee the correct inclination of the different parts of the circuit.

Finally, in the remaining inner space of the lower portion 19 of block 10 an electromagnetic stopping device, known per se, is housed, comprising as essential elements a control electromagnet 22 and a moving stopping pin 23 which, when stopping device is actuated, moves between the two arms of the Y-shaped printed circuit and enters the hole F provided in sector 4*s*. Similarly to what has been described in connection with emitting sensors E, also receiving sensors R are housed in suitable cavities of portion 19, outwardly closed by sapphire slides and inwardly sealed with oil-resistant resins. Spacers, sealing means and blocking means complete the device.

This particular arrangement of receiving sensors R and of block 10 containing them allows to obtain a number of both construction and operation advantages. From a construction point of view, the fact that receiving sensors R and the electromagnetic stopping device 22, 23 may be mounted in a separate and fully open body, as is precisely the portion 19 of block 10, simplifies by a great deal mounting operations, reduces the times thereof, and allows to have a perfect and repeatable angular positioning of receiving sensors R and a much sturdier and more protected structure.

From an operational point of view, firstly the compact form of block 10, the closeness between sensors R and the electromagnetic stopping device 22,23 and the fact of using direct-type sensors allow to dramatically mitigate the negative effects on the reading sensitivity of sensors R determined by the vibrations induced by the actions of the stopping device 22,23. The box-shape of block 10 and the closure thereof through sealing means makes the inside of the same also fully inaccessible to dusts and other grime, preserving cleanliness and hence the good operation of the components. The sharp front tapering of portion 19 and the well-radiused shape thereof leave then a wide free space in front of the weft feeder, wherein the ballooning effect of the threads may hence develop in without resistances during the collection thereof, with the advantage of greater efficiency (high thread-collection speed), of better fabric quality (less thread stress) and of energy savings (less air consumption). Finally, the mounting of block 10 at a very short distance from the upper surface of sector 4*s* allows to keep perfectly clean the pairs of sensors $E_2/R_2$, $E_Z/R_Z$, $E_S/R_S$ from the dust which accumulates in the gaps between sectors 4 and fingers 5, also due to the fact that these three pairs of sensors are arranged at a very short distance one from the other.

From the preceding description it is clear how the weft feeder of the present invention has fully reached the set objects. As a matter of fact, the particular position of the emitting sensors E inside the upper sector 4*s* of drum T allows to have no increase of the bulk of this element and hence not to affect the condition of minimum diameter of the drum with respect to the weft feeders provided with reflection sensors. The weft feeder according to the present invention hence now becomes extremely competitive with respect to reflection-sensor weft feeders, having removed the only limit which previously characterised it and having drastically simplified and made reliable the mounting of emitting sensors E on sector 4*s*. Said mounting, as a matter of fact, is now far less critical than the correct positioning of suitably-inclined mirror surfaces on this same sector is, as required for the operation of reflection sensors, especially when the surface of said sensor is plasma-treated in order to increase the abrasion resistance thereof.

Thanks to the particular, close and symmetrical arrangement of emitting sensors E and of receiving sensors R, it is then possible to obtain a high sensitivity and stability of the signals of thread presence/absence, also in the case of low-count threads, as well as excellent detectability of very dark, clear or highly reflecting wefts, thus achieving also the second object of the invention.

Finally, joining in a single compact block, provided with a radiused surface, both the receiving sensors R and the electromagnetic stopping device 22, 23, allows to have a wide space in front of the weft feeder for thread ballooning, without inducing harmful stresses in the thread, thus reaching also the third object of the invention.

However, it is understood that the invention must not be considered limited to the particular arrangement illustrated above, which represents only an exemplifying embodiment thereof, but that a number of variants are possible, all within the reach of a person skilled in the field, without departing from the scope of the invention, as defined by the following claims.

The invention claimed is:

1. Weft feeder device for threads, in particular for weaving looms, of the type comprising a main body (1) within which there is housed an electric motor driving a rotary shaft (2), the rotary shaft (2) driving into rotation, with its middle portion, a rotor (3) and a drum (T) rotatably mounted on the end portion of said rotary shaft (2) and kept fixed thereto by magnetic means (6, 7) and wherein there are furthermore provided pairs of optical emitting/receiving sensors (E, R) respectively arranged on the drum (T) and on an extension of the main body (1) of the weft feeder which extends laterally to the lateral surface of the drum (T), said pairs of sensors (E, R) being apt to detect the presence/absence of a thread passing therebetween, characterised in that the outer surface of said drum (T) consists of multiple independent sectors (4), and in that said emitting sensors (E) and the relative feeding and control circuit are embedded in the thickness of one (4*s*) of said sectors (4), arranged opposite said extension of the main body (1) of the weft feeder.

2. Weft feeder device as claimed in claim 1), wherein said sector (4*s*) of the drum (T) housing the emitting sensors (E) consists of two portions which may be coupled, an inner one (11) and an outer one (12), respectively, between which the feeding and control circuit, whereon said emitting sensors (E) are wired, is sandwiched, and wherein said circuit is a flexible printed circuit (13).

3. Weft feeder device as claimed in claim 2), wherein said emitting sensors (E) are SMD-type LEDs.

4. Weft-feeder device as claimed in claim 2), wherein said emitting sensors (E) are housed in holes formed in said outer portion (12), said holes being closed on the outside by sapphire slides and sealed on the inside by oil-proof resins.

5. Weft-feeder device as claimed in claim 2), wherein said emitting sensors (E) comprise stock-start and stock-end sensors ($E_1$, $E_2$), arranged on a line parallel to the axis of the weft-feeder at the beginning of the drum (T) and near the hole (F) housing the thread-stopping pin (23), respectively, as well as control sensors ($E_z$, $E_s$) for controlling the number of collected coils, arranged symmetrically and laterally to the hole (F) housing the thread-stopping pin (23) and near the same.

6. Weft feeder device as claimed in claim 1), furthermore comprising an induction feeding circuit of said emitting sensors (E) comprising two annular-shaped electric coils ($B_p$, $B_s$) housed in respective magnet cups (6, 7) integral with the weft feeder body (1) and with drum (T), respectively, on opposite sides of said rotor (3), said magnet cups (6, 7) making up said magnetic means.

7. Weft feeder device as claimed in claim 6), wherein said electric coils ($B_p$, $B_s$) have equal diameters, or only slightly different diameters, and directly face each other, at opposite sides of said rotor (3).

8. Weft feeder device as claimed in claim 1), wherein said receiving sensors (R) are housed, together with the electromagnetic thread-stopping device, in the lower portion (19) of a control block (10) projecting from the main body (1) of the weft feeder, said control block making up said extension of the main body (1) of the weft feeder which extends laterally to the lateral surface of the drum (T).

9. Weft feeder device as claimed in claim 8), wherein said receiving sensors (R) are formed on two printed circuits, one for each lying plane of said sensors, said printed circuits being housed in respective seats provided in the lower portion (19) of the control block (10) and blocked in position by a single clamp (21).

10. Weft feeder device as claimed in claim 8), wherein the outer surface of said control block (10) is entirely evenly radiused, i.e. fully devoid of sharp angles and corners, and furthermore it is sharply tapered in the front part thereof.

* * * * *